US005992713A

United States Patent [19]

Manabat

[11] Patent Number: 5,992,713

[45] Date of Patent: Nov. 30, 1999

[54] CLOTHES HANGER WITH SLIDABLE SIDE ATTACHMENTS

[76] Inventor: Gregorio S. Manabat, 7262 Melrose St., Apt. 313, Buena Park, Calif. 90621

[21] Appl. No.: 09/177,927

[22] Filed: Oct. 23, 1998

[51] Int. Cl.[6] ..... A47G 25/48; A47G 23/14

[52] U.S. Cl. ..... 223/91; 223/96

[58] Field of Search ..... 223/95, 96, 91, 223/90, 85

[56] References Cited

U.S. PATENT DOCUMENTS

| | | | |
|---|---|---|---|
| 737,335 | 8/1903 | Burrell | 223/96 |
| 1,991,987 | 2/1935 | Smith | 223/96 |
| 2,656,077 | 10/1953 | Gensky et al. | 223/96 |
| 3,268,128 | 8/1966 | Hobi | 223/96 |
| 4,638,930 | 1/1987 | Blanchard | 223/85 |
| 5,289,956 | 3/1994 | Petrou | 223/85 |

*Primary Examiner*—Bibhu Mohanty
*Attorney, Agent, or Firm*—James G. O'Neill

[57] ABSTRACT

A garment hanger having a body with a top hook and a hanging rod, including a pair of clamps rotatably and slidably held on the hanger rod, by a pair of supporting arms and hanging elements to support various portions of garments on or from the hanging rod of the hanger, in selected positions. The hanging rod may include a shaped opening having a liner held therein to slidably hold top portions of the hanging elements and the pair of supporting arm and the hanging elements may include releasable-shaped areas and complementary recessed areas to enable the supporting arms and clamps to be incrementally rotated.

10 Claims, 8 Drawing Sheets

CLOTHES HANGER WITH SLIDABLE SIDE ATTACHMENTS

BACKGROUND OF THE INVENTION

1. Field of the Invention

This invention relates generally to clothes hangers, and, more particularly, to a clothes hanger having rotatable and slidable clip means held thereon.

2. Description of Related Art

Plastic, wire and wood hangers are well known for hanging various garments in closets, and the like, for display and/or to prevent wrinkling. Many such hangers have either movable or rotatable clips or fingers formed thereon or secured thereto to retain various garments by a waistband, pant leg, or other portion of the garment.

Examples of known hangers having movable, resilient or rotatable clips or fingers are set forth in U.S. Pat. No. 3,744,685 to Hart, U.S. Pat. No. 4,382,531 to Bisk et al., U.S. Pat. No. 4,852,777 to Balkin et al., U.S. Pat. No. 5,082,152 to Chen and U.S. Pat. No. 5,082,133 to Duester et al.

Although these known garment hangers provide improvements in holding garments thereon, there still exists problems of handling and hanging different size garments on such known hangers. Additionally, some persons have difficulties in using the available hangers, or the holding elements thereon. Therefore, there still exists a need in the art for an improved garment hanger, which is more versatile and easier to operate, and which will solve many of the known problems with existing garment hangers.

SUMMARY OF THE INVENTION

It is, therefore, a general object of the present invention to provide an improved garment hanger. It is a particular object of the present invention to provide an improved garment hanger having more easily operated securing means. It is another particular object of the present invention to provide an improved garment hanger which includes securing means slidably attached thereto. It is yet another particular object of the present invention to provide an improved garment hanger having a pair of clips which are slidable on a hanger rod. And, it is still another particular object of the present invention to provide an improved garment hanger which is easily and quickly used to hold various types of garments of different sizes and shapes thereon, by rotatable and slidable holding clips held in an elongated opening formed in a hanger rod.

These and other objects and advantages of the present invention are achieved by providing a garment hanger having a body with a top hook and a hanging rod, together with a pair of clamping means slidably held on the hanger rod, to support various portions of garments on or to the hanging rod of the hanger, in selected positions. Depending on the garment being held, the clamping means may also be rotatable to secure the garment.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved garment hanger for use in easily and quickly supporting garments thereon, in a more efficacious manner.

Figure 1:
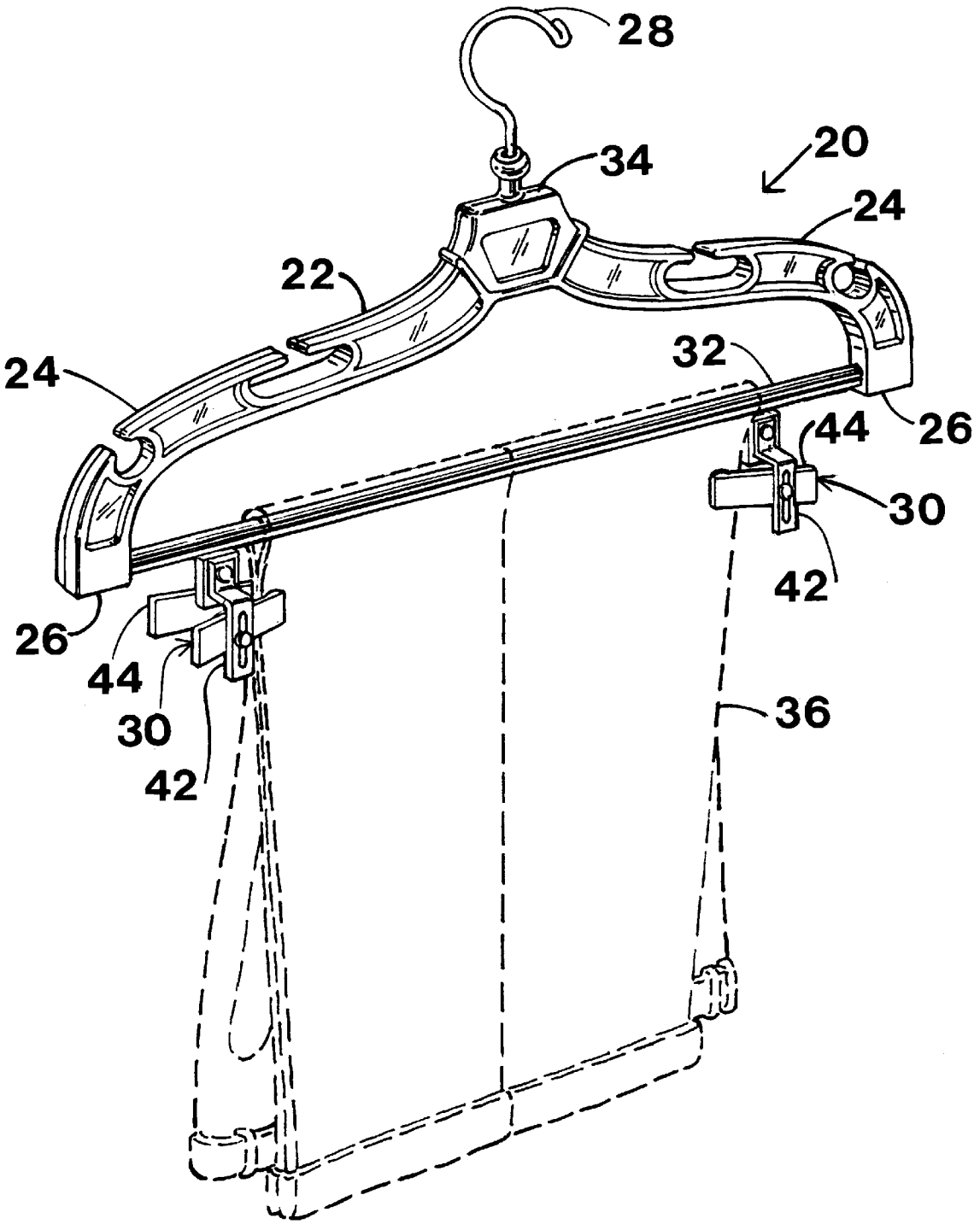
FIG. 1 is a perspective view showing one embodiment of an improved garment hanger of the present invention, holding a pair of pants on a hanger rod with a pair of holding clips, slidably held in the hanger rod, maintaining the pants in place.
Figure 2:
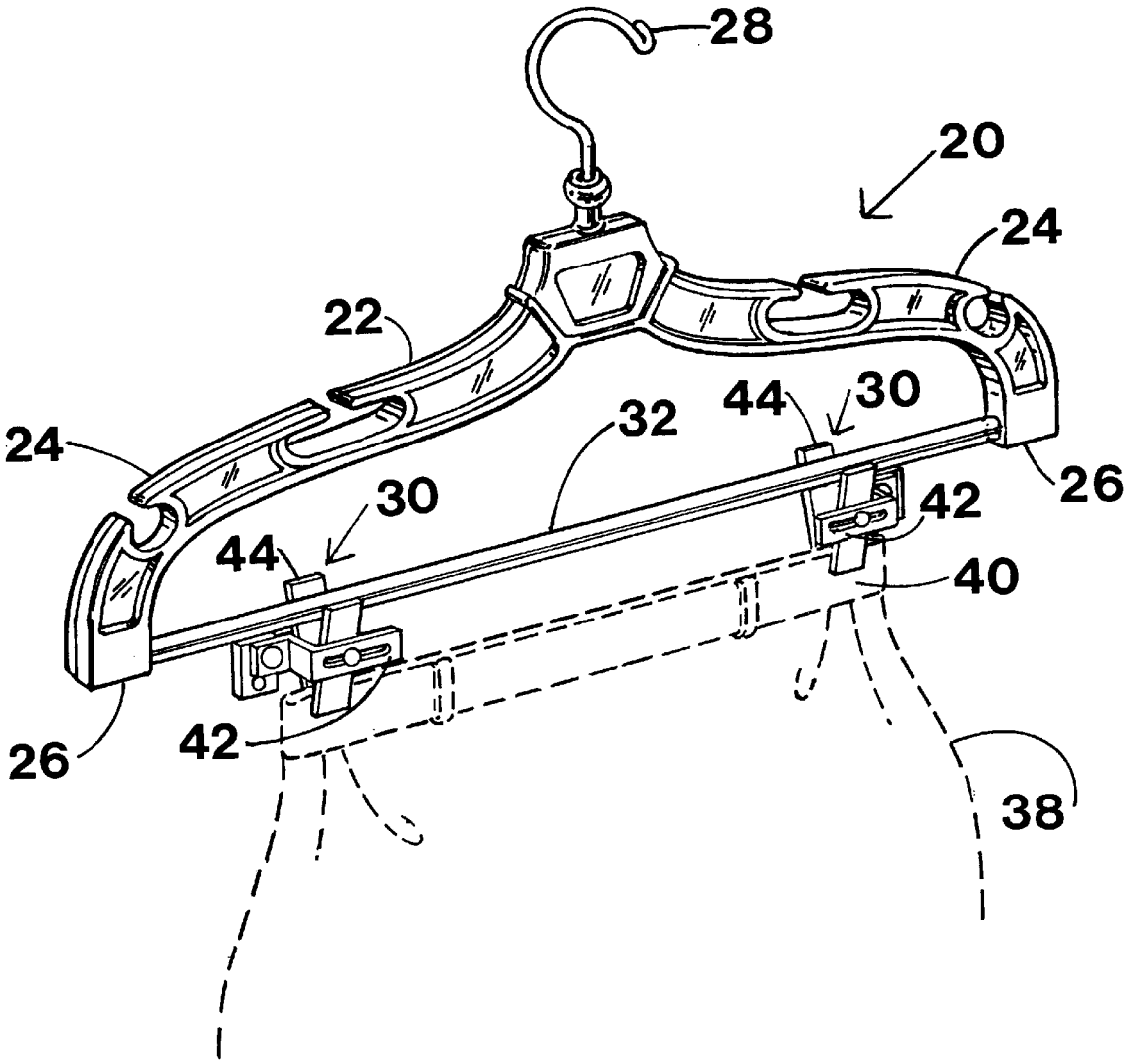
FIG. 2 is a further perspective view of a garment hanger of the present invention supporting a skirt from a hanger rod, with a pair of holding clips, slidably held in the hanger rod, rotated into different positions to maintain the skirt in place.
Figure 3:
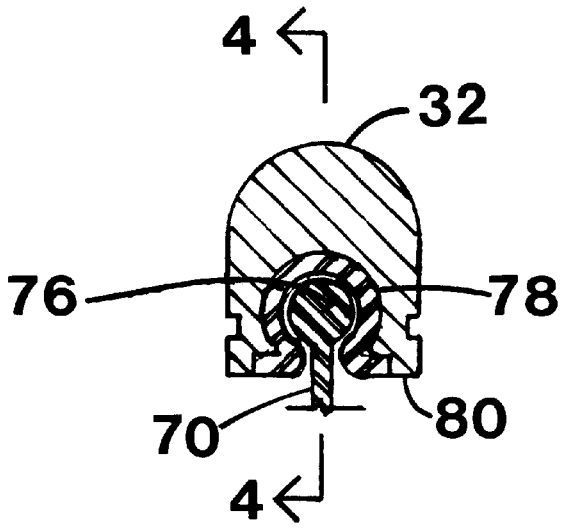
FIG. 3 is an enlarged partial cross-sectional view taken through the hanger rod and one of the holding clips of FIG. 1.
Figure 4:
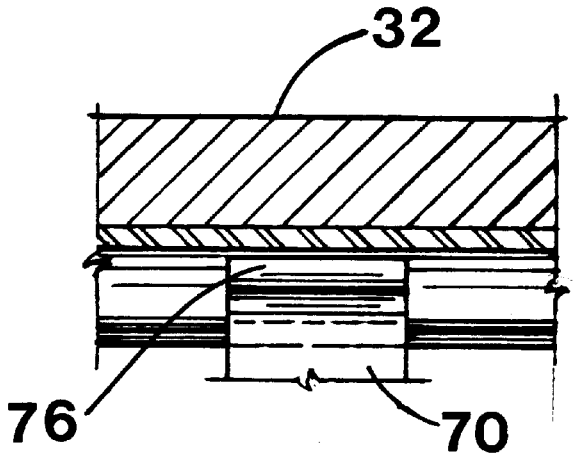
FIG. 4 is a cross-sectional view taken along line 4—4 of FIG. 3.
Figure 5:
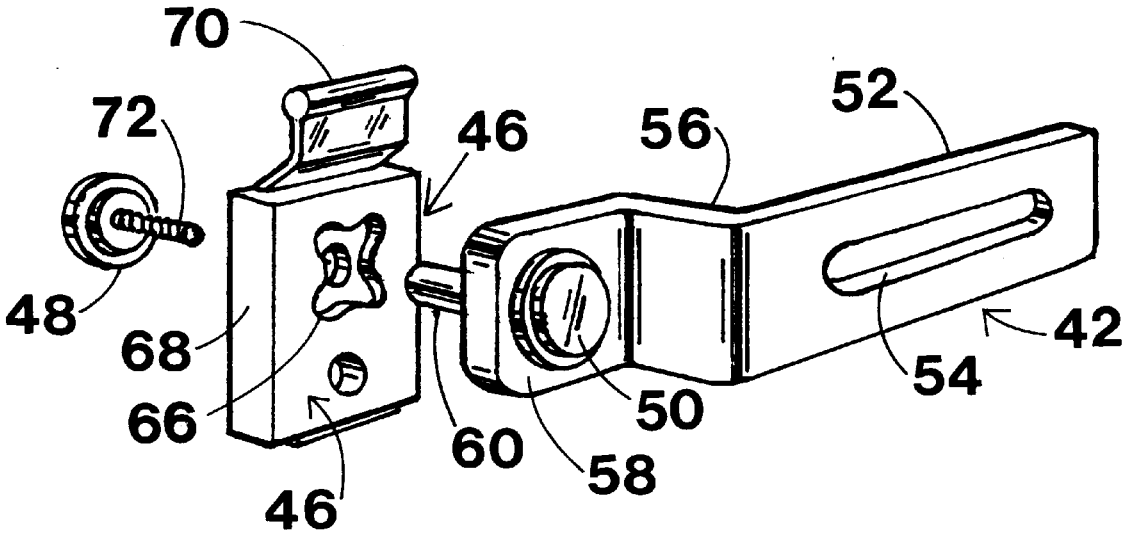
FIG. 5 is an exploded perspective view of a slide member and a holding element for a holding clip of the present invention.
Figure 5A:
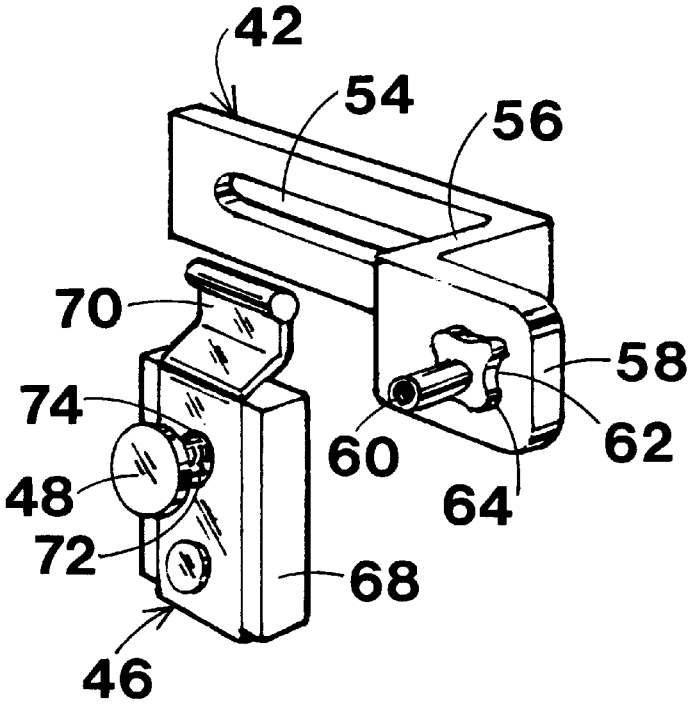
FIG. 5A is a further exploded perspective view of the slide member and holding element shown in FIG. 5.
Figure 7:
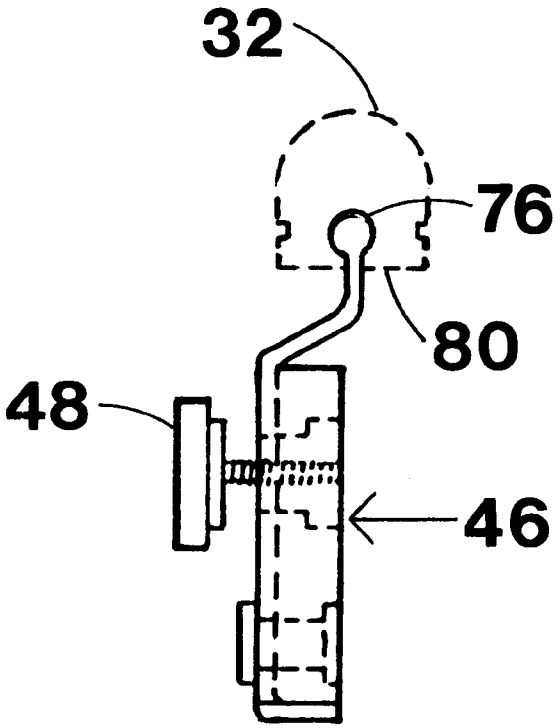
FIG. 7 is a side elevational view of the slide member of FIG. 6.
Figure 6:
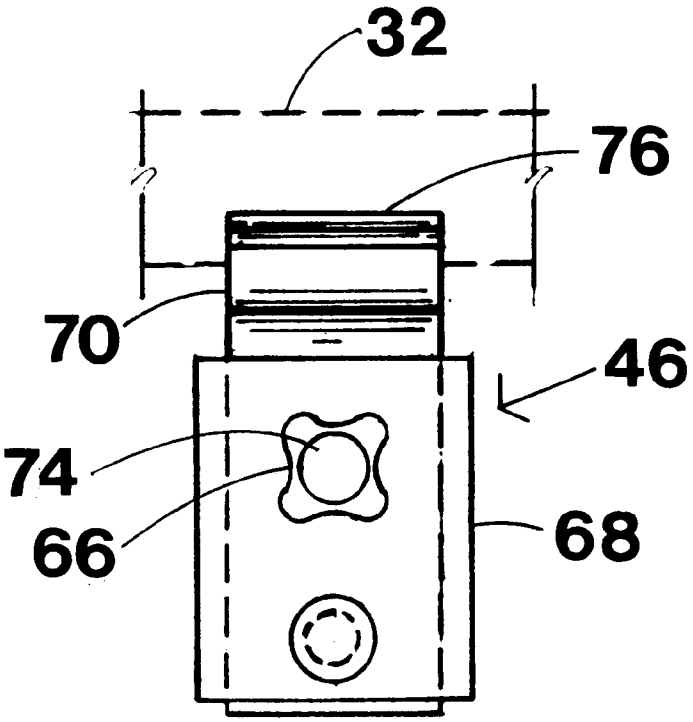
FIG. 6 is a front elevational view of one of the slide members.

Turning now to the drawings, and particularly FIGS. 1 and 2, there shown is a currently preferred embodiment of the garment hanger of the present invention, generally indicated at 20. The hanger 20 is shown as having a body 22, with a pair of shoulders 24, terminating in ends 26. The body 22 is preferably constructed from a rigid plastic material, with a plurality of openings formed therein, and includes a swivel wire hook 28. Clamping or holding means 30, preferably made from metal, are slidably held on or in a hanger rod 32. It should be understood by those skilled in the art, that other suitable materials may be used, and that the use of plastic or metal materials are by way of example only, and are not meant to limit how the garment hanger 20 and the clamping means 30, of the present invention, may be manufactured. Furthermore, since the clamping or holding means 30 shown and used herein are identical, the description of one is deemed to be sufficient for both.

The main body 22 of the hanger 20 has left and right sloping free-form shapes with openings formed therein adjacent the shoulders 24. An apex 34 having a flat top and measuring about two inches (2") in width is formed between the shoulders 24. At about the center of this flat apex 34, the wire hook 28 is rotatably mounted so as to swivel 360°. A hanger or support rod 32 is secured between the two (2) ends 26. This hanger or support rod may be of any desired shape and size, for example round, or may include a rounded upper portion and a flattened lower portion. Each end of the hanger rod 32 is permanently joined or secured in the body 22 of the hanger, adjacent the ends 26, in any desired manner. FIG. 1 illustrates how a pair of pants or trousers 36 may be hung on rod 32, and secured in place by a pair of the clamping or holding means 30, cooperating with the sides of the pants. The clamping or holding means 30 may include hooks thereon for mounting on the hanger rod 32, or may be slidably secured in the hanger rod, as described more fully below.

As best shown in FIG. 2, when using the hanger 20 to support, for example, pants by their cuffs, or a skirt 38 by its waistband 40, holding arms, elements or members 42 are rotated so that clamping elements or members 44 are approximately horizontal (at about 90° to the position shown in FIG. 1), as explained more fully below.

Turning now to FIGS. 3–12, the operation and use of the clamping or holding means 30 will be described. The holding means 30 is comprised of a plurality of elements including the holding arm, element or member 42, the clamping element or member 44 and a hanging or slide element or member 46, held together by a plurality of fastening means 48, 50, such as, for example, externally and internally threaded mating members.

The holding arm, element or member 42 is preferably made from and includes an elongated flat or planar portion 52 having an elongated slot 54 formed therein. One end of the elongated flat portion 52 has a further offset portion, which may be L-shaped, having a pair of perpendicular legs 56, 58 formed therewith, or secured thereto, as by welding. One of the fastening means 48, 50, such as the member 50, having a tubular portion thereof 60, which is internally threaded, is secured to an opening in the leg 58. Preferably, the internally threaded tubular portion 60 of member 50 is formed so as to have a shaped end portion 62 secured thereto, at one side of leg 58. The shaped end portion 62 includes a plurality of lobes 64 which mate with an identically shaped recessed area 66, formed on one side of a slide element 46, as explained more fully below.

Figure 8:
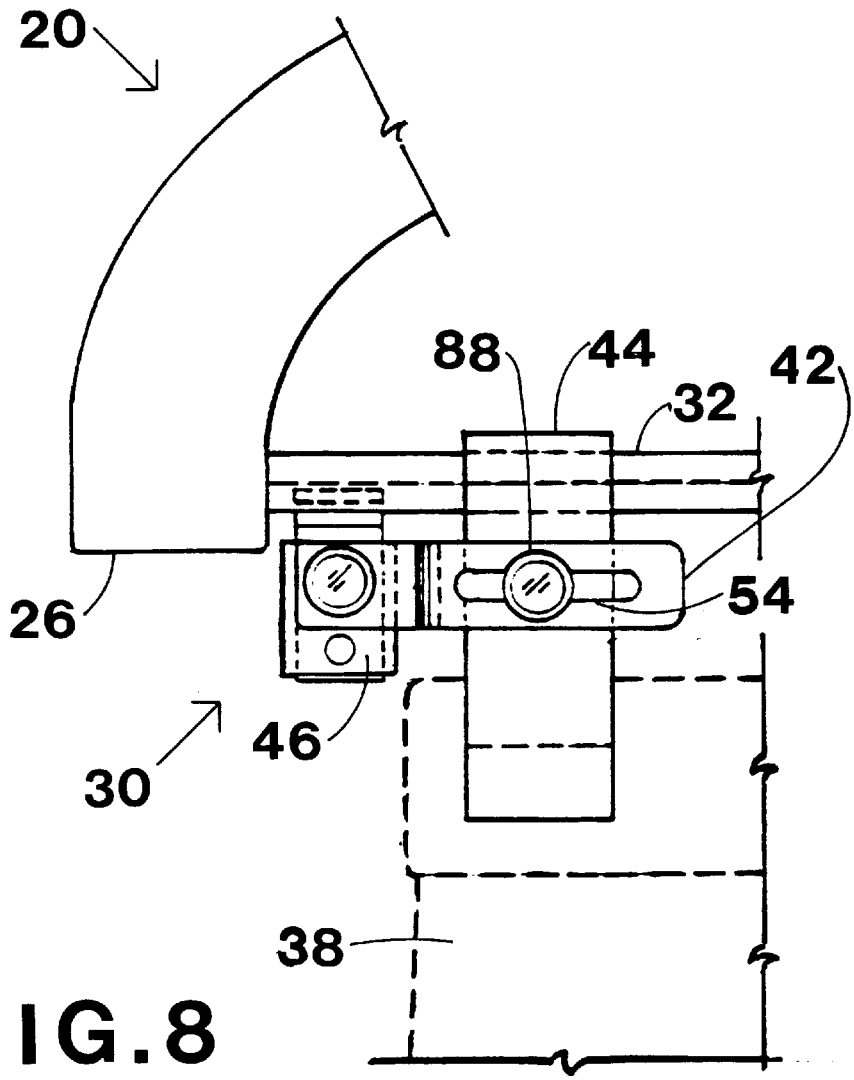
FIG. 8 is an enlarged partial front elevational view of one end of the hanger and hanger rod showing the slide member, holding means and a holding clip in a vertical position; 6.
Figure 9:
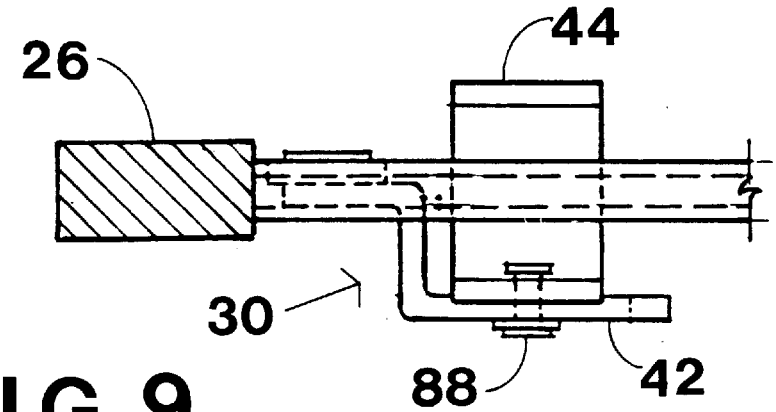
FIG. 9 is a bottom plan view of FIG. 9.
Figure 10:
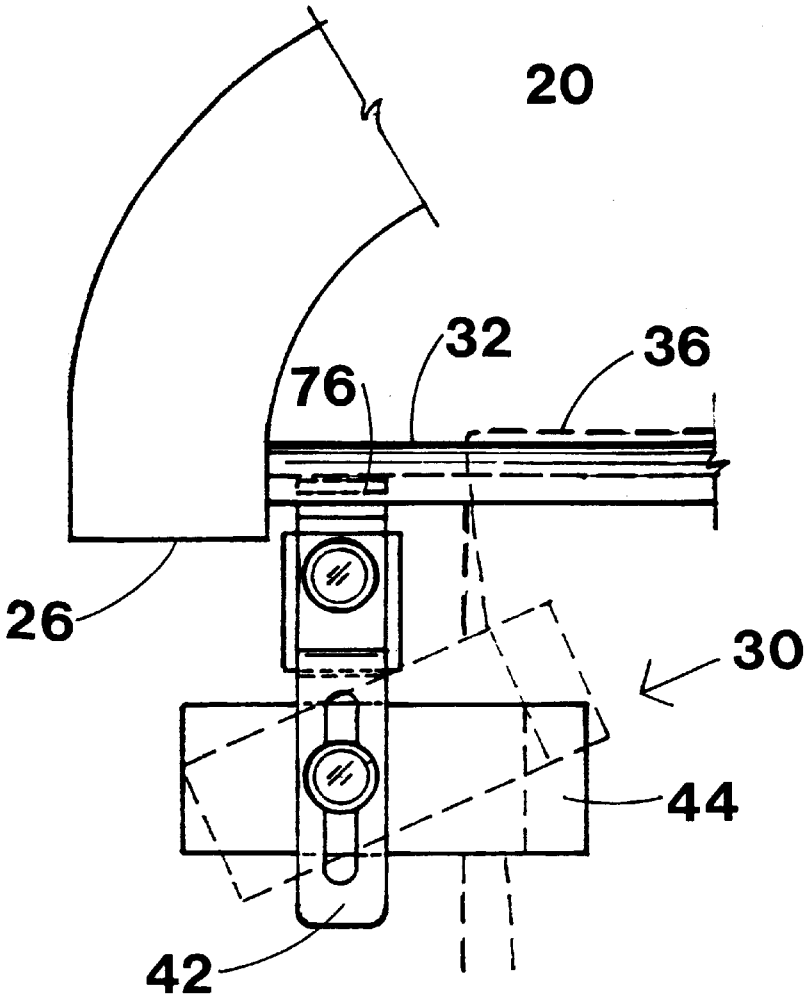
FIG. 10 is a further enlarged partial front elevational view, similar to FIG. 8, with the holding clip and holding means rotated to different positions.
Figure 11:
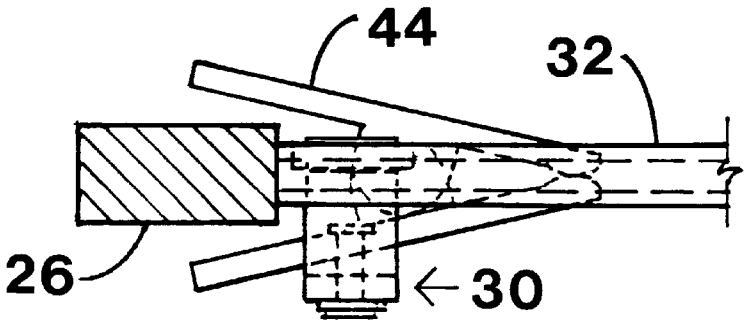
FIG. 11 is a bottom plan view of FIG. 10.
Figure 12:
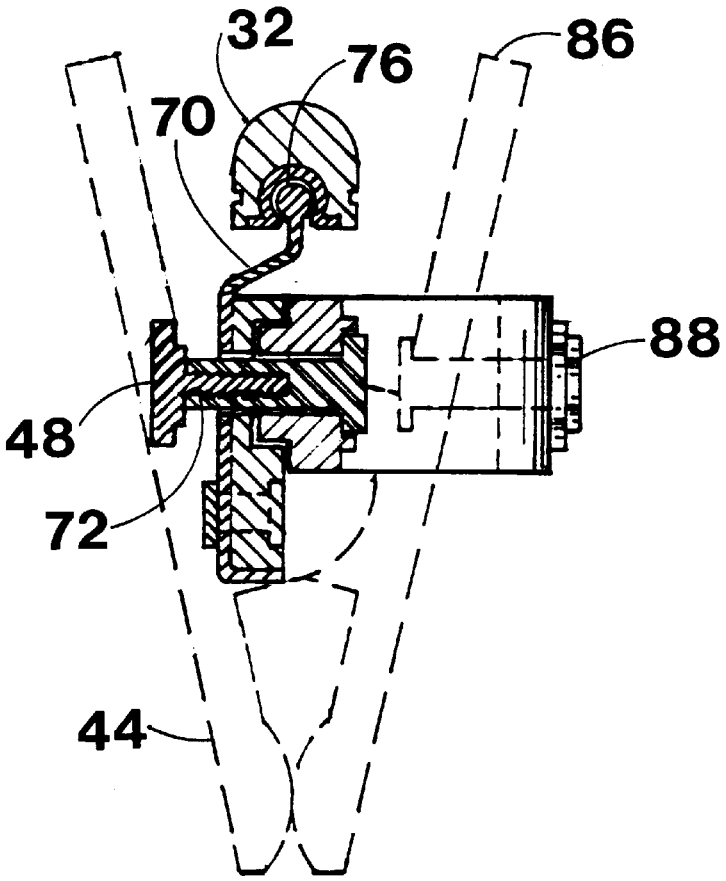
FIG. 12 is a an enlarged side elevational view, partially in cross section, of FIG. 8.
Figure 13:
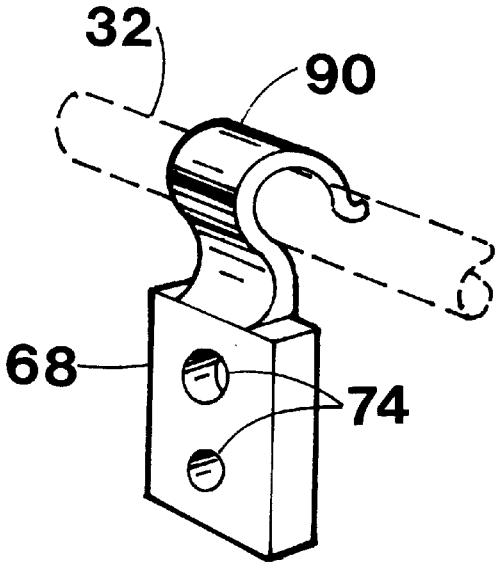

The hanging or slide element 46 includes a lower portion 68 and an upper portion 70 formed therewith or secured thereto. The lower portion 68 includes the recessed area 66 formed therein on one side thereof. The recessed area 66 fits into and mates with the shaped end portion 62 to maintain the holding arm or element 42 at a selected angle with respect to the slide element 46. That is, with a threaded end 72 of fastener 48 inserted through an aperture 74 passing through the approximate center of the recessed area 66 and secured in tubular portion 60, the enlarged end of fastener 48 may be turned to lock and unlock the elements 42 and 46 together. The locking of elements 42 and 46 together is accomplished by the cooperation of the lobes 64 with corresponding shaped portions in recessed area 66. That is, when shaped end portion 62 is inserted into and mates with recessed area 66, the elements 42 and 46 will be locked or secured together. However, if fastener 48 is loosened, to allow elements 42 and 46 to be separated far enough that the shaped end portion 62 is withdrawn from recessed area 66, the holding arm or element 42 may be rotated, with respect to element 46, a selected amount. For example, if there are four lobes 64 on shaped end portion 62, and four corresponding shaped portions in recessed area 66, the holding arm or element may be rotated either clockwise or counterclockwise, when looking at FIGS. 1, 2, 5, 8, and 10, one or more lobe-shaped portions. For example, as shown in FIG. 1, the holding arms 42 are secured so as to be held approximately 90° to the rod 32, while in FIG. 2 the arms 42 have been moved counter-clockwise, approximately 90° (two lobes/shaped portions), so as to be parallel to rod 32. FIG. 8 shows the arm 42 in the same position as FIG. 2, while FIG. 10 shows the arm 42, in solid line, in the same position as FIG. 1, and in broken line, moved approximately 45° (one lobe/shaped portion.

The upper portion 70 of the hanging or slide element 46 may end in a hook to place over a round hanger rod 32, or as shown in FIGS. 3, 8, 10 and 12 may end in an enlarged or beaded portion 76. This enlarged portion 76 is slidably captured in a keyhole-shaped opening 78 formed in the lower flattened portion 80 of hanging rod 32. The keyhole-shaped opening preferably includes a liner 82 extending along the entire length thereof to aid the enlarged portion 76 in sliding therein and to strengthen the opening. This liner may be made of any desired material, for example, a plastic.

FIGS. 5–8 illustrate one embodiment of claiming members 44, comprised of two (2) movable jaws 84, 86, rotatable about an axial metal rod, not shown. Joined to one of the movable jaws 84, 86 of the clamping members 44, is a securing means 88, slidably held in the elongated slot 54, to enable the clamping members 44 to be adjustably mounted therein for movement along the slot.

In operation, as shown in FIGS. 1 and 2, both clamping means 44 are secured by their respective holding arms 42 and hanging or slide elements 46 on or in the rod 32, and both rotated and slid into position whereby they can grip opposite ends of sides of the pair of folded trousers 36 or hanging skirt 38, supported by rod 32, to further secure the pants or skirt in position, with respect to the rod 32, and thereby prevent them from falling or moving. FIG. 2 also illustrates how the clamping means may hold the ends or leg-cuffs of pants 36, as well as the skirt 38, to thereby display and support the full length thereof. Because the clamping means 44 are secured in their respective positions in the opening liner 78, 82 in the elongated rod 32, each clamping member 44 may be easily moved to aid in securing different sized garments, and the like, hung on or supported by the rod 32.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A garment hanger including a body with a top apex having a wire hook rotatably secured therein, first and second free formed shoulders, a first flattened end and a second flattened end supporting a hanging rod therebetween; the improvement comprising:

a first clamping element slidably secured in the hanging rod;

a second clamping element slidably secured in the hanging rod;

a first elongated arm secured to the first clamping element; and a second elongated arm secured to the second clamping element; whereby the first clamping element and the second clamping element may be both slid and rotated to various positions along the hanging rod, to aid in supporting a garment on or from the hanging rod.

2. The garment hanger of claim 1, further including sliding elements supporting the first clamping element and the second clamping element in an opening formed in the hanging rod.

3. The hanger of claim 2 wherein the sliding elements include upper portions and lower portions, and the first elongated arm and the second elongated arm are releasably secured in the lower portions by shaped portions cooperating with corresponding recessed portions.

4. The garment hanger of claim 3 wherein the shaped portions include a plurality of lobes and the recessed portions are a plurality of complementary shaped areas on the lower portions.

5. The garment hanger of claim 4 wherein the upper portions include beaded portions slidably held in a liner secured in a keyhole-shaped elongated opening formed in the hanging rod.

6. A garment hanger including a body with a top apex having a wire hook rotatably secured therein, a pair of shoulders and a pair of ends supporting a hanging rod therein; the improvement comprising:

a first clamping means rotatably and slidably secured on the hanging rod;

a second clamping means rotatably and slidably secured on the hanging rod;

the first clamping means and the second clamping means including a rotatable elongated arm having an elongated slot formed therein; a hanging element rotatably supporting the elongated arm; and a clamp element slidably mounted in the elongated slot; and the hanging element of the first clamping means and the second clamping means being slidably secured in an opening formed in the hanging rod.

7. The garment hanger of claim 6 wherein the hanging element includes an upper portion and a lower portion, with the upper portion secured in a liner held in the opening formed in the hanging rod, and the lower portion supporting the elongated arm therein.

8. The garment hanger of claim 7 wherein the lower portion and the elongated arm are releasably secured together by mating shaped portions having a plurality of shaped lobes and complementary shaped recessed portions.

9. The garment hanger of claim 8 wherein the plurality of shaped lobes and the complementary shaped recessed portions may be separated to allow the elongated arm to be rotated.

10. The garment hanger of claim 9 wherein the first clamping means and the second clamping means are comprised of two wing handles, held together by an axial rod, and are rotatably and slidably held in an elongated opening formed in the elongated arm to which they are attached.

* * * * *